US006328307B1

(12) United States Patent
Saldana

(10) Patent No.: US 6,328,307 B1
(45) Date of Patent: Dec. 11, 2001

(54) CHILDREN'S WISHING GAME

(76) Inventor: Frank Saldana, 3153 Maury St., Richmond, VA (US) 23224

( * ) Notice: Subject to any disclaimer, the term of this patent is extended or adjusted under 35 U.S.C. 154(b) by 0 days.

(21) Appl. No.: 09/505,824

(22) Filed: Feb. 17, 2000

(51) Int. Cl.[7] ..... A63F 1/10

(52) U.S. Cl. ..... 273/292; 273/293; 273/148 A; 273/459; 283/117; 281/31; 40/124.06; 446/147

(58) Field of Search ..... 273/292, 293, 273/240, 148 A, 459; 283/117; 281/31; 40/124.06; 446/147

(56) References Cited

U.S. PATENT DOCUMENTS

| | | | | |
|---|---|---|---|---|
| D. 249,982 | | 10/1978 | Kubusheski . | |
| 515,275 | * | 2/1894 | Bishoprick | 229/74 |
| 4,174,059 | | 11/1979 | Maunder . | |
| 4,187,703 | * | 2/1980 | Ippoliti et al. | 70/62 |
| 4,197,670 | | 4/1980 | Cox . | |
| 4,372,077 | | 2/1983 | Balbuena . | |
| 4,832,648 | | 5/1989 | Theobald et al. . | |
| 4,874,340 | | 10/1989 | Smallwood . | |
| 5,059,149 | | 10/1991 | Stone . | |
| 6,103,332 | * | 8/2000 | McDonald | 428/99 |

* cited by examiner

*Primary Examiner*—Benjamin H. Layno
(74) *Attorney, Agent, or Firm*—Norman B. Rainer

(57) ABSTRACT

A children's game is provided, including a figurine having a compartment for receiving flat objects, at least one card dimensioned to be insertable into the compartment, and a lock for sealing the compartment. The game is intended to enable a child to make a wish and, in a ritualistic manner, expect to enhance the realization of the wish while at the same time keeping the wish a secret.

7 Claims, 3 Drawing Sheets

CHILDREN'S WISHING GAME

BACKGROUND OF THE INVENTION

1. Field of the Invention

This invention concerns a children's game, and more particularly relates to a game which enables children to secretively express their thoughts and desires.

2. Description of the Prior Art

A fundamental human trait is the expression of wishes, hopes and desires relating to future eventualities. It is often sought to enhance the fulfillment of the mentally conceived wish by way of physical actions. Such actions include for example vocalization in words, prayers or song, ritualistic gestures, dances and ceremonies, and the use of objects believed to have sacred, magical, or supernatural powers.

Some commonly accepted ritualistic traditions concerning the fruition of wishes include: blowing out candles on a birthday cake; crossing of the fingers; throwing coins into a wishing well; rubbing a rabbit's foot; lighting of candles; payment to a religious organization; throwing rice at a wedding; the breaking of a wish-bone; and a "toast" involving the contacting of upraised beverage-filled drinking glasses.

Children are often apprehensive as to what the future holds for them. Since their societal experience is short in comparison with their future expectations, children find solace in wishing and in superstitious activities wherein their interaction may bolster the success of their wish. In many instances the child may want to keep a particular wish secret as part of his or her private dream world of fears an joys.

Dolls, figurines and statues having animal or human features have long been used in ritualistic activities concerning wishes or prayers. For example, voodoo dolls believed to have magical powers have been used in the Caribbean Area,and totem poles have been popular in Hawaii and Alaska. Some of such dolls and figurines have functional characteristics which are interactive with the user. One particular interactive feature relates to the ability of the doll or figurine to hold or conceal an object by way of an internal compartment. Examples of such features are disclosed in U.S. Pat. Nos. D249,982; 4,174,059; 4,197,670; 4,372,077; 4,832,648; 4,874,340; and 5,059,149.

However, no prior art is known wherein a doll or figurine has an internal compartment which serves as one aspect of a ritualistic children's game for making wishes.

It is accordingly an object of the present invention to provide a ritualistic children's game for making wishes and keeping said wishes secret.

It is a further object of this invention to provide a game as in the foregoing object which involves the use of a figurine having an internal compartment.

It is another object of the present invention to provide a game of the aforesaid nature wherein said compartment can be locked by the child playing the game.

It is a still further object of this invention to provide a game of the aforesaid nature wherein the child player can describe in writing or drawings a multitude of desired wishes.

It is yet another object of the present invention to provide a game of the aforesaid nature of simple, durable construction amenable to low cost manufacture and packaging.

These objects and other objects and advantages of the invention will be apparent from the following description.

SUMMARY OF THE INVENTION

The above and other beneficial objects and advantages are accomplished in accordance with the present invention by a children's wishing game comprising:

1) a figurine having a compartment for receiving flat objects, said compartment having a single opening and being otherwise closed, said opening having lockable closure means,
2) a lock for engaging said closure means,
3) at least one card of adequate rigidity, size and shape to be slideably inserted into said compartment, said card having at least one surface which can receive and display written indicia, and
4) instruction information concerning the significance and playing of the game.

For the purposes of the present invention, the expression "figurine" is intended to denote a structure which is ornamental by way of indicia and/or structural features to represent something familiar to children, such as people, animals, plants or places. The figurine may be a conventional doll or other toy object, but is preferably a substantially flat envelope-like structure ornamented on at least one side by way of shape, printed indicia and/or add-on appendages. In another embodiment of the game of this invention, at least one erasable marking device is included.

In playing with, the aforesaid game components, the child holds a card and makes a wish. The "wish" may be expressed graphically in words or pictures drawn onto the card, or may merely be a thought associated with the card. The child then inserts the card into the compartment, and locks the closure means. The child has earlier been informed, either by way of said instructions or verbally by an adult, that such ritualistic action enhances the fulfillment of the wish. If alternatively, someone else were to learn what the child wished for, then the wish surely would not come true. Regardless of the effect of secrecy on the success of the wish, the child is also led to understand that he or she can enjoy privacy in their lives, particularly with respect to their thoughts or wishes.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
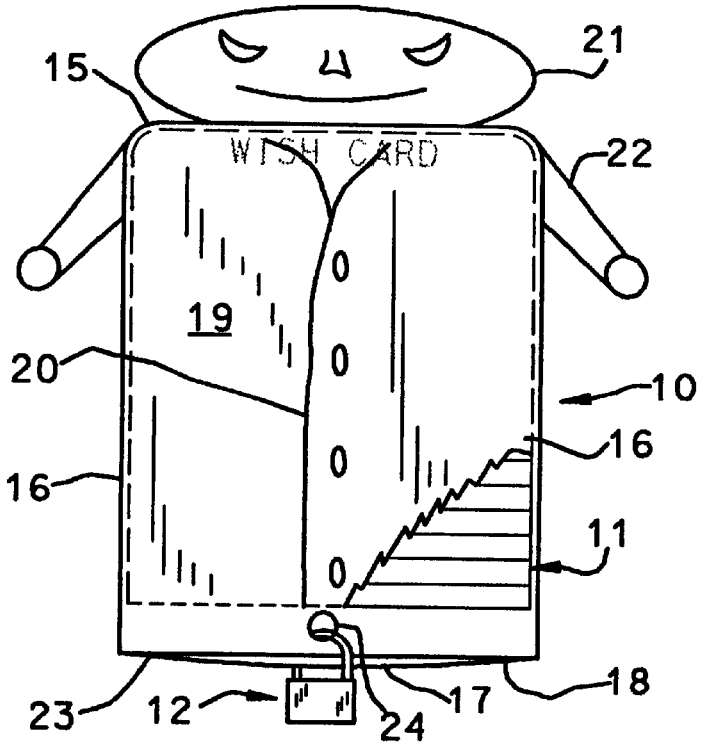
FIG. 1 is a front perspective view of a first embodiment of the game of the present invention showing game components in an assembled state, and with portions broken away to reveal interior details.
Figure 2:
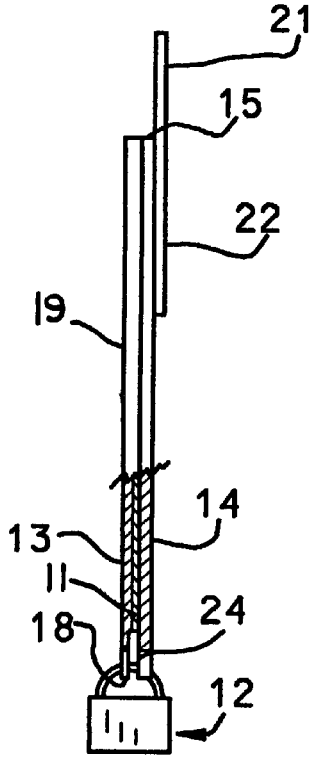
FIG. 2 is a side view of the embodiment of FIG. 1.

Referring now to FIGS. 1 and 2, an embodiment of the children's wishing game of the present invention is shown comprised of figurine 10, card 11 and lock 12. Said figurine is exemplified as comprised of flat front and rear panels 13 and 14, respectively, lying in close adjacency and sealed together at their top and side edges 15 and 16, respectively, thereby defining an interior compartment 17 having an opening 23 at the bottom edges 18 of said panels. The exemplified shape of said compartment is rectangular, wherein the parallel side edges 16 are longer than the parallel top and bottom edges 15 and 18, respectively.

The exterior face 19 of front panel 13 contains pictorial indicia 20. Top and side appendages 21 and 22, respectively, are emergent from the top and side edges of said panels, the appearance of said appendages being consistent with indicia 20 so as to present a unified motif or depiction of a person, animal, plant or other subject familiar to children. Said front and rear panels are provided with lockable closure means in the form of aligned apertures 24. Said apertures may be within the boundary of compartment 17, or may be present on tabs 25 that project away from said panels as continuous integral extensions thereof.

Card 11 is constructed of reasonably stiff material to permit slidable insertion through opening 23 and into compartment 17. The size and shape of card 11 must also be compatible with the dimensions of said compartment. In some embodiments, card 11 may be considered to have an upper extremity 26 which is first to enter said compartment, an opposite lower extremity 27, and side edges 28. The length of the card, measured between said upper and lower extremities, must be no longer than the length of compartment 17, and the width of said card, measured between side edges 28 must be no longer than the width of said compartment. Card 11 may be provided with an auxiliary aperture 29 positioned so as to align with apertures 24 when said card is fully inserted into said compartment.

At least one surface of card 11 must be of a nature which will accept written indicia as from pencil, ink, crayon or erasable marking pen. As a component of the game of the present invention, there may be a number of cards 11. Such cards may be of disposable paper construction, or may be fabricated of plastic sheet material which will permit repeated use, especially in conjunction with an erasable marking device 33.

Lock 12 may be a conventional lock having a key or combination opening mechanism. The shank 30 of the lock is of sufficiently small diameter to pass through apertures 24.

Figure 3:
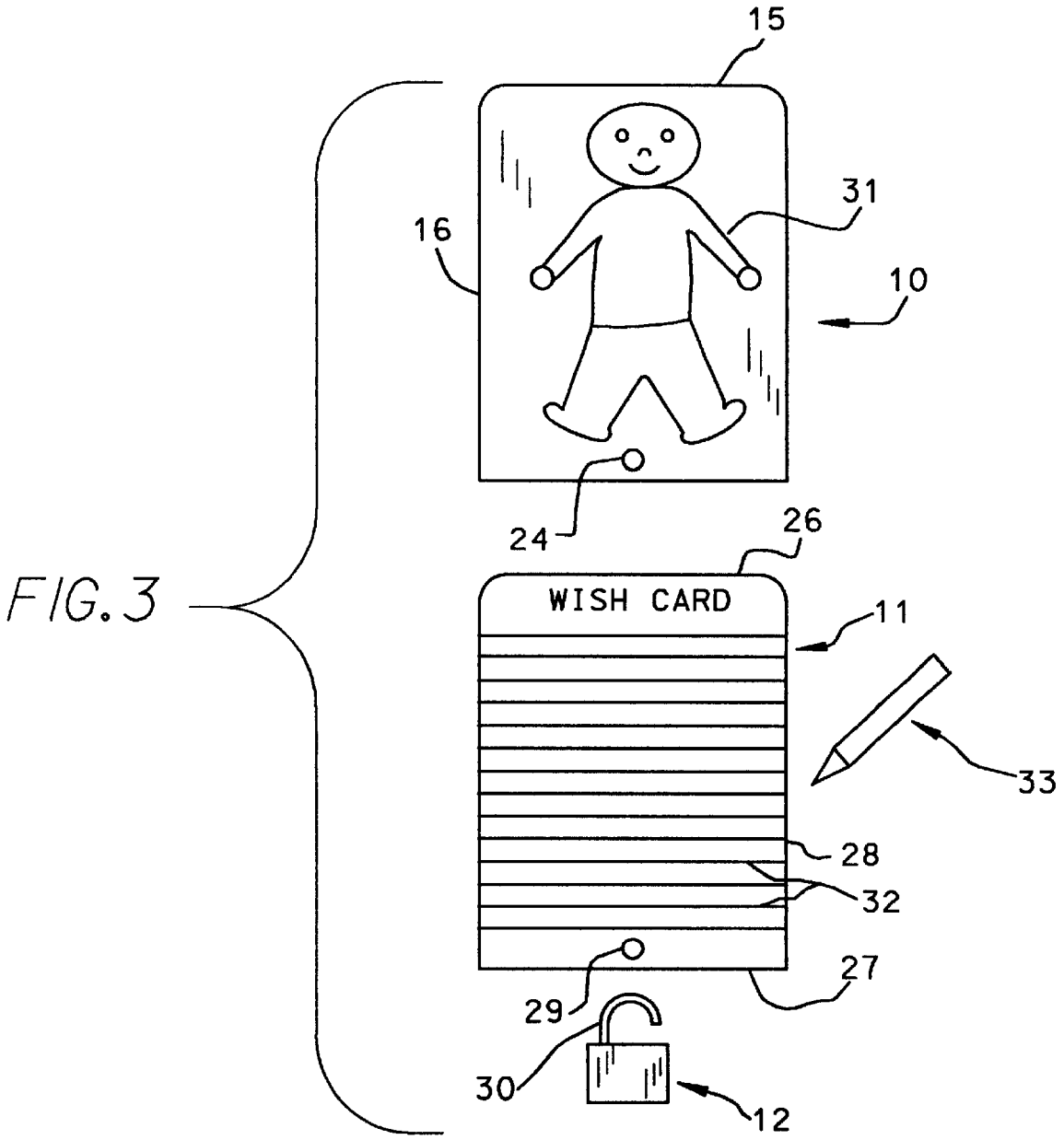
FIG. 3 is an exploded front view of a second embodiment of the game of this invention.

The second embodiment of the invention, as shown in FIG. 3, exemplifies a figurine which is essentially just a flat envelope having indicia 31 on front panel 13 depicting a subject familiar to a child. Card 11 is also shown to have indicia in the form of a series of parallel lines 32 to facilitate the writing of a wish or other message. It is to be understood however, that in playing the game, the child need not write anything on card 11. The child can merely make a wish, then insert the card into compartment 17, and apply the lock. In this manner, the child will feel that, not only will the wish come true, but it is maintained an absolute secret.

Figure 4:
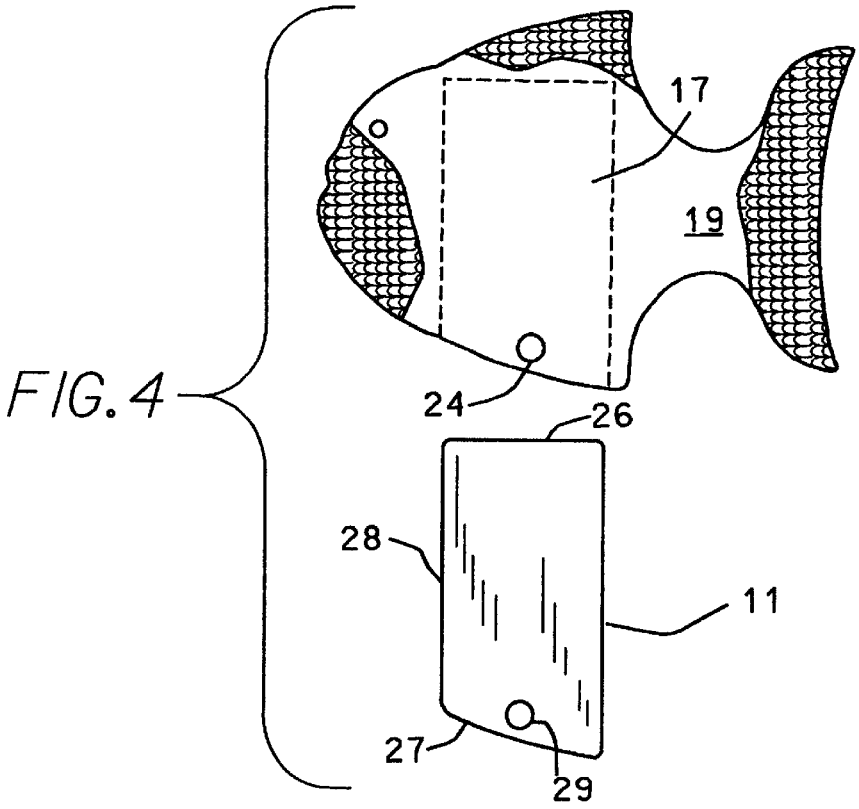
FIG. 4 is an exploded front view of a third embodiment of the invention.

In the third embodiment of the game of the present invention, as shown in FIG. 4, the figurine has a fish-like contour, and card 11 is shaped to conform with the shape of compartment 17.

Figure 5:
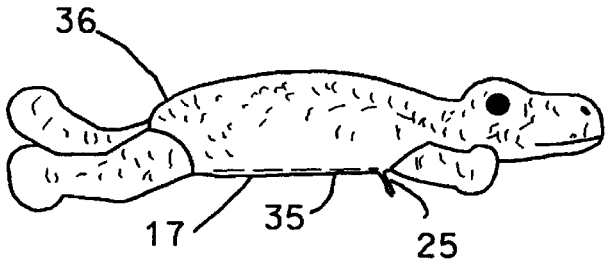
FIG. 5 is a side view of a fourth embodiment of the invention.
Figure 6:
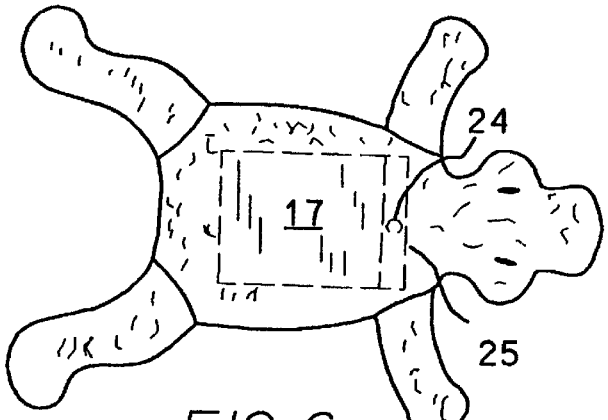
FIG. 6 is a rear view of the embodiment of FIG. 5.

In the fourth embodiment of the game, as shown in FIGS. 5 and 6, the figurine has a three-dimensional configuration as in a traditional stuffed toy 36 representing an animal, and compartment 17 is located on the underside of the animal, mid-length thereof. Aligned paired tabs 25 facilitate the opening of the compartment by pulling down upon lower panel 35, which in this instance is considered the front panel of compartment 17 because it is this panel which faces the user. The tabs have apertures 24 to facilitate insertion of lock 12.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A children's wishing game comprising:

a) a figurine having a compartment for receiving flat objects, said compartment having a single opening and being otherwise closed, said opening having lockable closure means, said closure means having aligned apertures, b) a lock having a shank of sufficiently small diameter to pass through said aligned apertures for engaging said closure means, c) at least one card of adequate rigidity, size and shape to be slideably inserted into said compartment and locked in said compartment by said lock and closure means, said card having at least one surface which can receive and display written indicia, and d) instruction information concerning the significance and playing of the game.

2. The game of claim 1 wherein said figurine is ornamented by way of features including indicia and structure to represent subjects familiar to children, said subjects including people, animals, plants and places.

3. The game of claim 1 wherein said figurine is an envelope structure comprised of flat front and rear identical rectangular panels sealed together at three common edges.

4. The game of claim 3 wherein said rectangular panels have parallel side edges and parallel top and bottom edges shorter than said side edges,said bottom edges remaining unsealed and constituting said single opening.

5. The game of claim 1 wherein said game further comprises at least one erasable marking device.

6. The game of claim 1 wherein said card is provided with an auxiliary aperture positioned so as to align with said aligned apertures.

7. The game of claim 1 further comprised of aligned paired tabs which are continuous integral extensions of said panels at said opening and containing aligned apertures.

* * * * *